US009590364B1

(12) United States Patent
Chang et al.

(10) Patent No.: US 9,590,364 B1
(45) Date of Patent: Mar. 7, 2017

(54) ELECTRICAL CONNECTOR

(71) Applicant: LOTES CO., LTD, Keelung (TW)

(72) Inventors: Wen Chang Chang, Keelung (TW); Jin Ke Hu, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/089,872

(22) Filed: Apr. 4, 2016

(30) Foreign Application Priority Data

Oct. 15, 2015 (CN) ..... 2015 2 0793583 U
Oct. 15, 2015 (CN) ..... 2015 2 0794974 U

(51) Int. Cl.
*H01R 24/60* (2011.01)
*H01R 13/6585* (2011.01)
*H01R 24/70* (2011.01)

(52) U.S. Cl.
CPC ..... *H01R 13/6585* (2013.01); *H01R 24/70* (2013.01)

(58) Field of Classification Search
CPC H01R 24/60; H01R 13/6585; H01R 23/7073; H01R 23/02; H01R 23/688; H01R 23/6873
USPC ..... 439/660, 108, 607.05
See application file for complete search history.

(56) References Cited

U.S. PATENT DOCUMENTS 7,534,141 B1 * 5/2009 Wu ..... H01R 24/62 439/607.01
7,670,156 B2 * 3/2010 Chen ..... H01R 13/6485 439/108
7,699,663 B1 * 4/2010 Little ..... H01R 13/65802 439/660
7,909,653 B1 * 3/2011 Wan ..... H01R 13/514 439/660
8,740,652 B2 * 6/2014 Hsueh ..... H01R 4/023 439/607.41
8,920,197 B2 * 12/2014 Tziviskos ..... H01R 13/405 439/660
2009/0042451 A1 * 2/2009 He ..... H01R 13/514 439/660
2011/0034083 A1 * 2/2011 Ko ..... H01R 13/506 439/607.58
2011/0269341 A1 * 11/2011 He ..... H01R 24/60 439/607.01
2012/0238146 A1 * 9/2012 Liao ..... H01R 31/06 439/660
2013/0149882 A1 * 6/2013 Luo ..... H01R 13/652 439/108

(Continued)

*Primary Examiner* — Gary Paumen
(74) *Attorney, Agent, or Firm* — Locke Lord LLP; Tim Tingkang Xia, Esq.

(57) ABSTRACT

An electrical connector including an insulating body, multiple terminals received in the insulating body, and a contact member. The insulating body includes a base and a tongue extending forward from the base. The tongue has a rear segment and a front segment, and the rear segment is higher than the front segment. Each terminal has a mating portion exposed from the front segment. The front segment has an isolation portion close to the rear segment, and the isolation portion is higher than the mating portion and lower than the rear segment. The contact member is disposed at the rear segment, and used for buckling a grounding elastic sheet of a mating connector during mating. The isolation portion is at least partially located on an insertion path of the grounding elastic sheet.

19 Claims, 10 Drawing Sheets

(56) References Cited

U.S. PATENT DOCUMENTS

| | | | | |
|---|---|---|---|---|
| 2013/0288520 | A1* | 10/2013 | Simmel | H01R 13/502<br>439/607.01 |
| 2014/0370729 | A1* | 12/2014 | Wang | H01R 13/6471<br>439/108 |
| 2015/0162714 | A1* | 6/2015 | Yu | H01R 24/62<br>439/660 |
| 2015/0340798 | A1* | 11/2015 | Kao | H01R 13/6594<br>439/660 |

* cited by examiner

ELECTRICAL CONNECTOR

CROSS-REFERENCE TO RELATED APPLICATIONS

This non-provisional application claims priority to and benefit of, under 35 U.S.C. §119(a), Patent Application No. 201520794974.1 and 201520793583.8 filed in P.R. China on Oct. 15, 2015, the entire contents of which are hereby incorporated by reference.

FIELD OF THE INVENTION

The present invention relates generally to an electrical connector, and more particularly to an electrical connector that effectively resolves a short circuit problem.

BACKGROUND OF THE INVENTION

The background description provided herein is for the purpose of generally presenting the context of the present invention and is neither expressly nor impliedly admitted as prior art against the present invention. The subject matter discussed in the background of the invention section should not be assumed to be prior art merely as a result of its mention in the background of the invention section. Similarly, a problem mentioned in the background of the invention section or associated with the subject matter of the background of the invention section should not be assumed to have been previously recognized in the prior art. The subject matter in the background of the invention section merely represents different approaches, which in and of themselves may also be inventions.

As shown in FIG. 1, a conventional USB Type C socket connector A includes an insulating body B having a base C and a tongue D, two rows of terminals disposed at the insulating body B, and a metal casing F framing the insulating body B. The two rows of terminals include at least one signal terminal, and each signal terminal has a contact portion E exposed on either of an upper surface and a lower surface of the tongue D. A USB Type C plug connector G includes an insulating housing H, a shielding casing L and two grounding sheets M. The insulating housing H has a mating portion I. The mating portion I forms a mating cavity J. Two rows of conducting terminals K are disposed on an upper surface and a lower surface of the mating cavity J. The shielding casing L wraps the insulating housing H. The two grounding sheets M respectively disposed on an upper surface and a lower surface of a front end of the mating portion I and located between the insulating housing H and the shielding casing L. Each of the grounding sheets M includes multiple elastic sheets N stretching into the mating cavity J.

However, after the socket connector A and the plug connector G of the foregoing structure are frequently mated, the elastic sheets N of the plug connector G collide with the tongue D of the socket connector A multiple times, which easily generates a pin collapse phenomenon, and causes the elastic sheets N to be moved backward in the mating cavity J. After pin collapse occurs in the elastic sheets N, when the plug connector G and the socket connector A are mated, the elastic sheets N easily contact the contact portion E of the signal terminal in the socket connector A, thereby causing a short circuit to occur in the socket connector A.

Therefore, a heretofore unaddressed need exists in the art to address the aforementioned deficiencies and inadequacies.

SUMMARY OF THE INVENTION

In one aspect, the present invention relates to an electrical connector in which a grounding elastic sheet of a plug connector is isolated from a terminal of a socket connector by disposing an isolation portion at a tongue, thereby preventing a short circuit.

In one embodiment, an electrical connector includes an insulating body, multiple terminals disposed at the insulating body, and a contact member. The insulating body has a base and a tongue extending forward from the base. The tongue includes a rear segment and a front segment. The rear segment is higher than the front segment. Each of the terminals includes a mating portion exposed on the front segment. An isolation portion is disposed at a location of the front segment that is close to the rear segment. The isolation portion is higher than the mating portion and lower than the rear segment. The contact member is disposed at the rear segment, and used for buckling a grounding elastic sheet of a mating connector during mating. The isolation portion is at least partially located on an insertion path of the grounding elastic sheet.

In one embodiment, there are multiple isolation portions separately disposed at two sides of each mating portion. In one embodiment, each of an upper surface and a lower surface of the front segment close to the rear segment is provided with multiple isolation portions.

In one embodiment, there are multiple isolation portions that are connected integrally and wrap a part of each mating portion that is close to the rear segment.

In one embodiment, the electrical connector further includes a shielding sheet at least partially located in the tongue, where the shielding sheet has a buckling slot protruding from a side surface of the tongue, and the buckling slot includes a first protruding portion located at a front end of the buckling slot and a second protruding portion located at a back end of the buckling slot.

In one embodiment, the isolation portion extends forward and exceeds the second protruding portion.

In one embodiment, the electrical connector further includes a metal casing framing the insulating body, where the metal casing surrounds the tongue to form an insertion cavity.

In one embodiment, the contact member includes a contact portion disposed at the rear segment and an extending portion extending from the contact portion to the base, and the extending portion is provided with an elastic arm urging the metal casing.

In one embodiment, each of two sides of the extending portion is provided with a locking sheet, the base is provided with a locking slot corresponding to each locking sheet, and the locking sheets are respectively inserted in the locking slots.

In one embodiment, a stopping portion higher than the contact member is disposed at a front end of the rear segment, and the stopping portion includes a guiding surface that is located between the isolation portion and the stopping portion and is higher than the isolation portion.

In one embodiment, the width of the grounding elastic sheet is greater than the width of the mating portion.

In one embodiment, the grounding elastic sheet and the mating portion are staggered.

In another aspect, the present invention relates to an electrical connector. In one embodiment, an electrical connector includes an insulating body, two buckling slots, multiple terminals, and an isolation portion. The insulating body includes a base and a tongue extending forward from the base. The two buckling slots are respectively located at a left side and a right side of the tongue. A back end of each of the buckling slots is provided with a protruding portion. The multiple terminals are disposed at the insulating body. Each of the terminals includes a mating portion exposed on the tongue. The isolation portion protrudes from the tongue and is higher than the mating portion. The isolation portion extends forward and exceeds the protruding portion.

In one embodiment, there are multiple isolation portions separately disposed at two sides of each mating portion. In one embodiment, each of an upper surface and a lower surface of the tongue is provided with multiple isolation portions.

In one embodiment, there are multiple isolation portions that are connected integrally and wrap a back end part of each mating portion.

In one embodiment, the buckling slots are depressed from the tongue.

In one embodiment, the electrical connector further includes a shielding sheet at least partially located in the tongue, where the shielding sheet includes a side edge protruding from a left side surface and a right side surface of the tongue, and the buckling slots are depressed from the side edge.

In one embodiment, the tongue includes a rear segment and a front segment, the rear segment is higher than the front segment, the isolation portion is disposed at the front segment and close to the rear segment, and the isolation portion is lower than the rear segment.

In one embodiment, a stopping portion higher than the contact member is disposed at a front end of the rear segment, and the stopping portion includes a guiding surface that is located between the isolation portion and the stopping portion and is higher than the isolation portion.

Compared with the related art, in certain embodiments of the present invention, multiple isolation portions are disposed at a boundary between the rear segment and the front segment of the tongue, each of the isolation portions is higher than the mating portion and lower than the rear segment, and moreover, the isolation portion is at least partially located on an insertion path of the grounding elastic sheet. After the mating connector and the electrical connector are frequently mated, the grounding elastic sheet collides with the tongue multiple times to generate a pin collapse phenomenon. In this case, the isolation portion isolates the grounding elastic sheet from the mating portion, which prevents a short circuit due to direct contact of the grounding elastic sheet to the mating portion.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
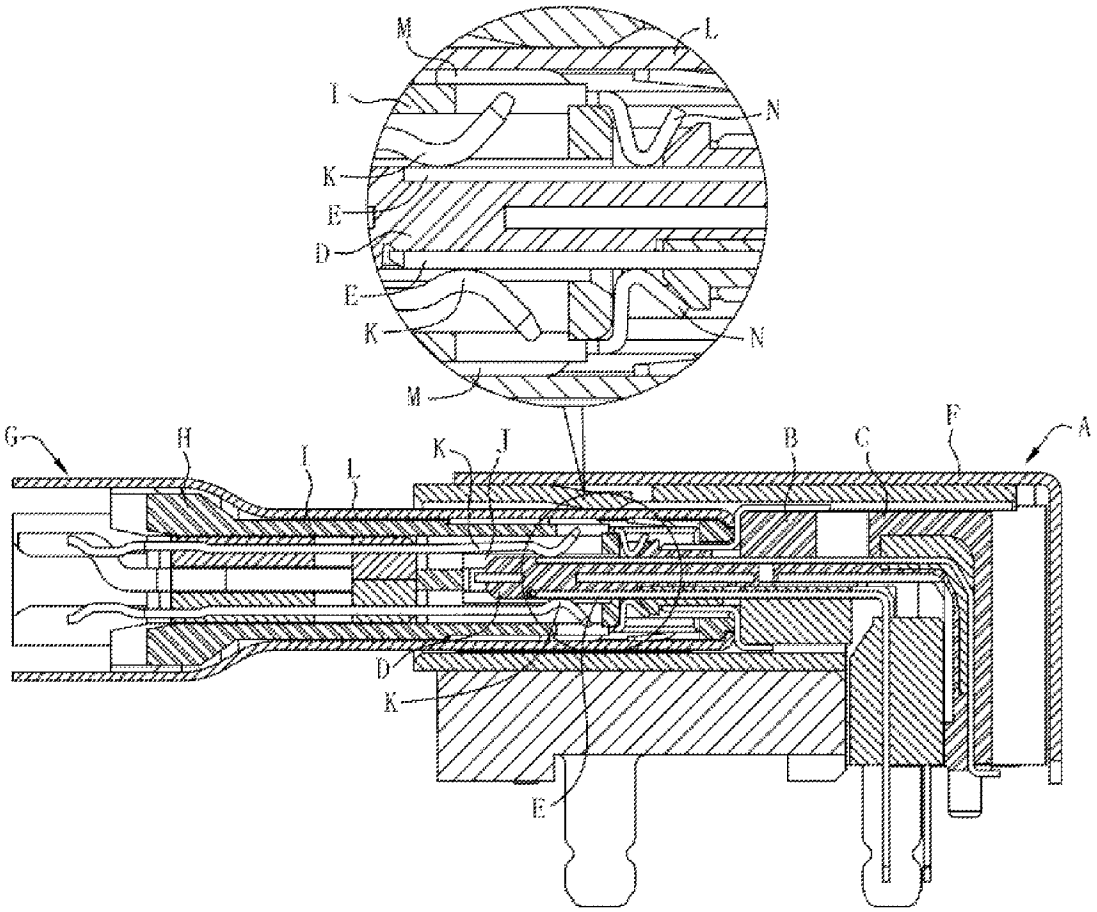
FIG. 1 is a sectional view obtained after a mating connector mates an electrical connector in the related art.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-10. In accordance with the purposes of this invention, as embodied and broadly described herein, this invention, in one aspect, relates to an electrical connector.

Figure 2:
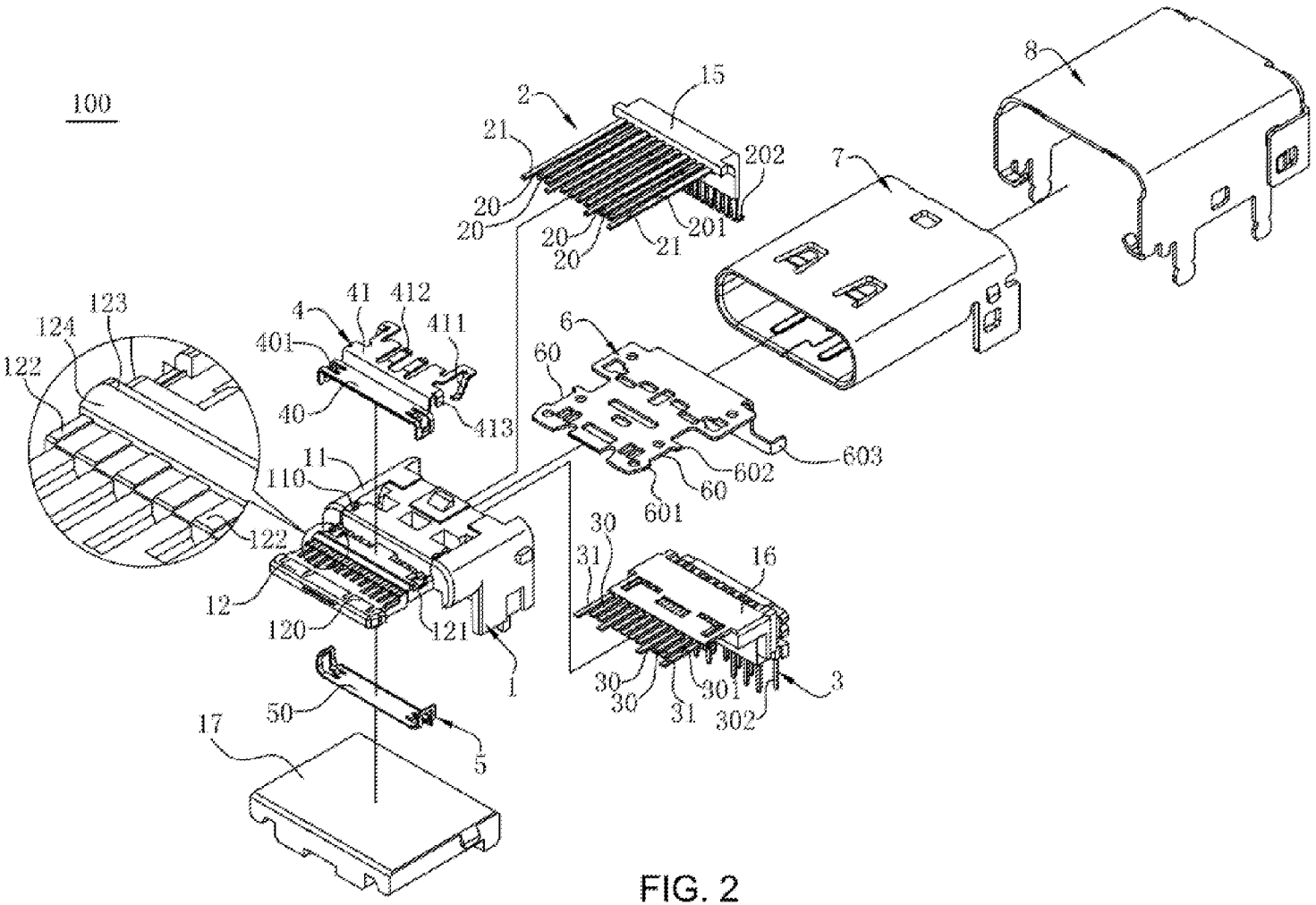
FIG. 2 is a schematic three-dimensional exploded view of an electrical connector according to one embodiment of the present invention.
Figure 3:
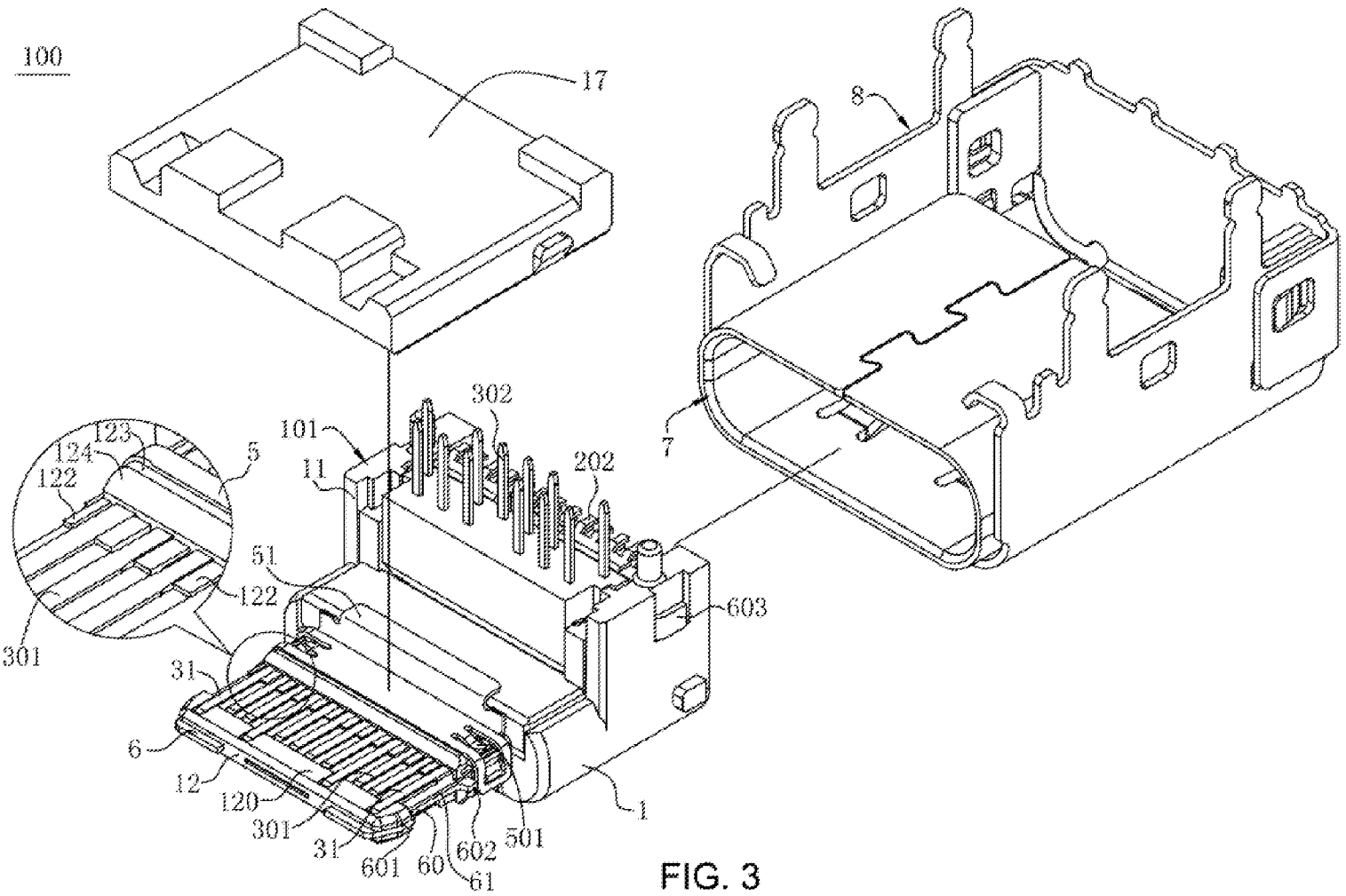
FIG. 3 is a partial three-dimensional exploded view of the electrical connector according to one embodiment of the present invention.
Figure 4:
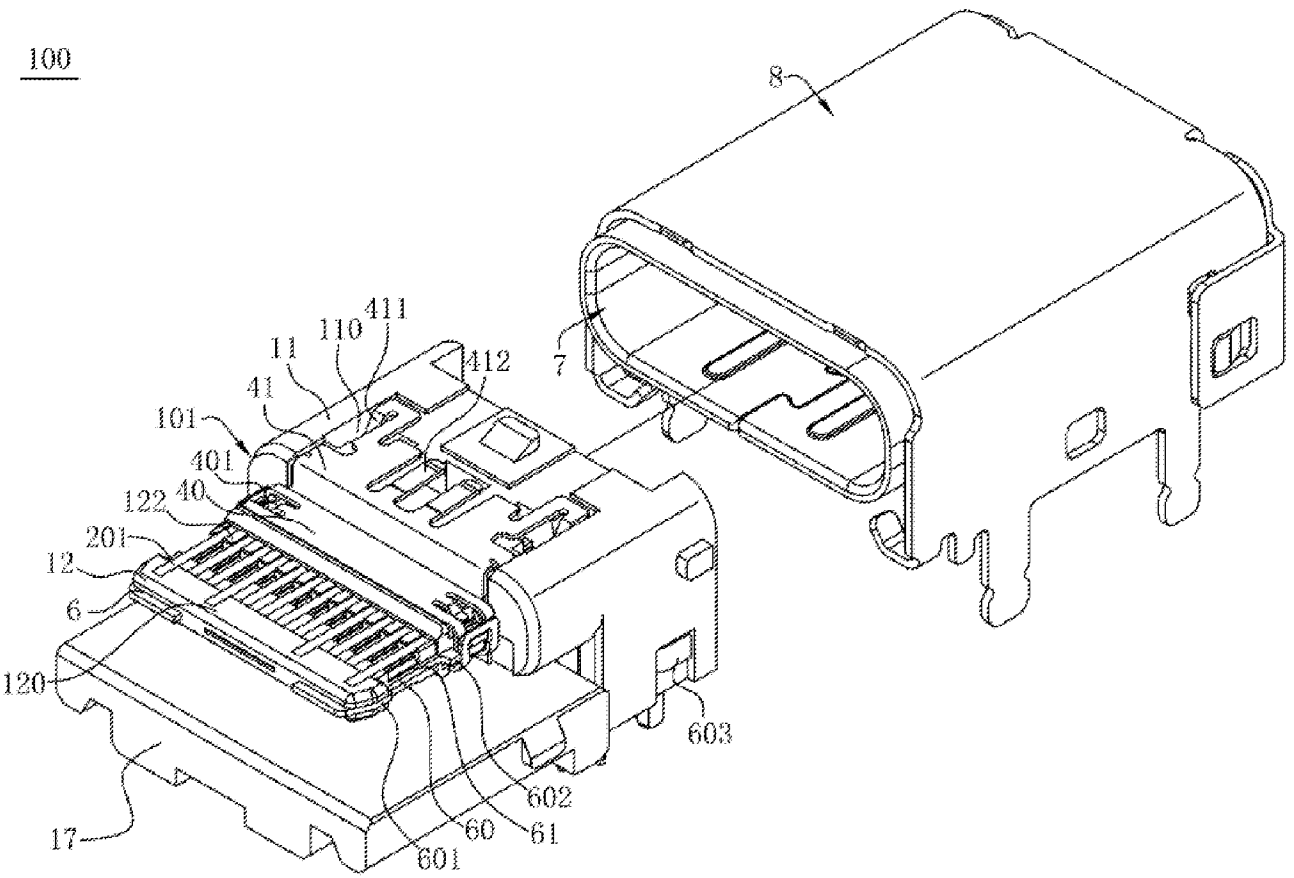
FIG. 4 is a partial three-dimensional exploded view at another angle of the electrical connector according to one embodiment of the present invention.
Figure 5:
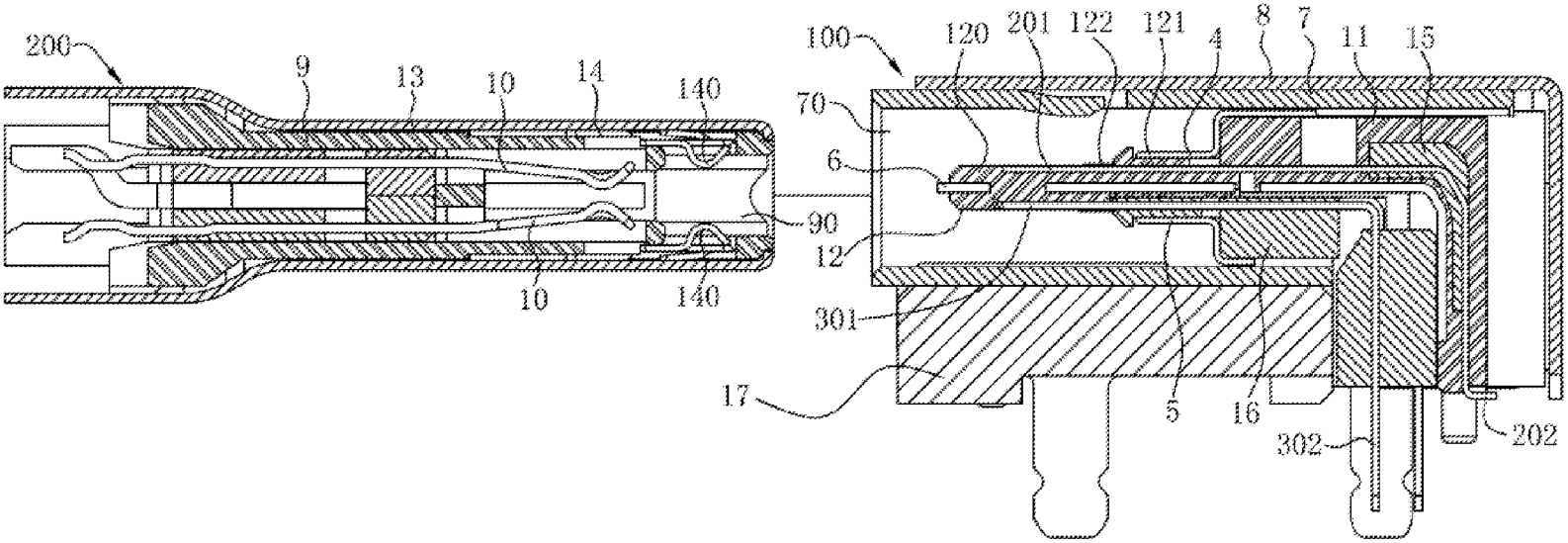
FIG. 5 is a sectional view obtained before the electrical connector mates the mating connector according to one embodiment of the present invention.
Figure 6:
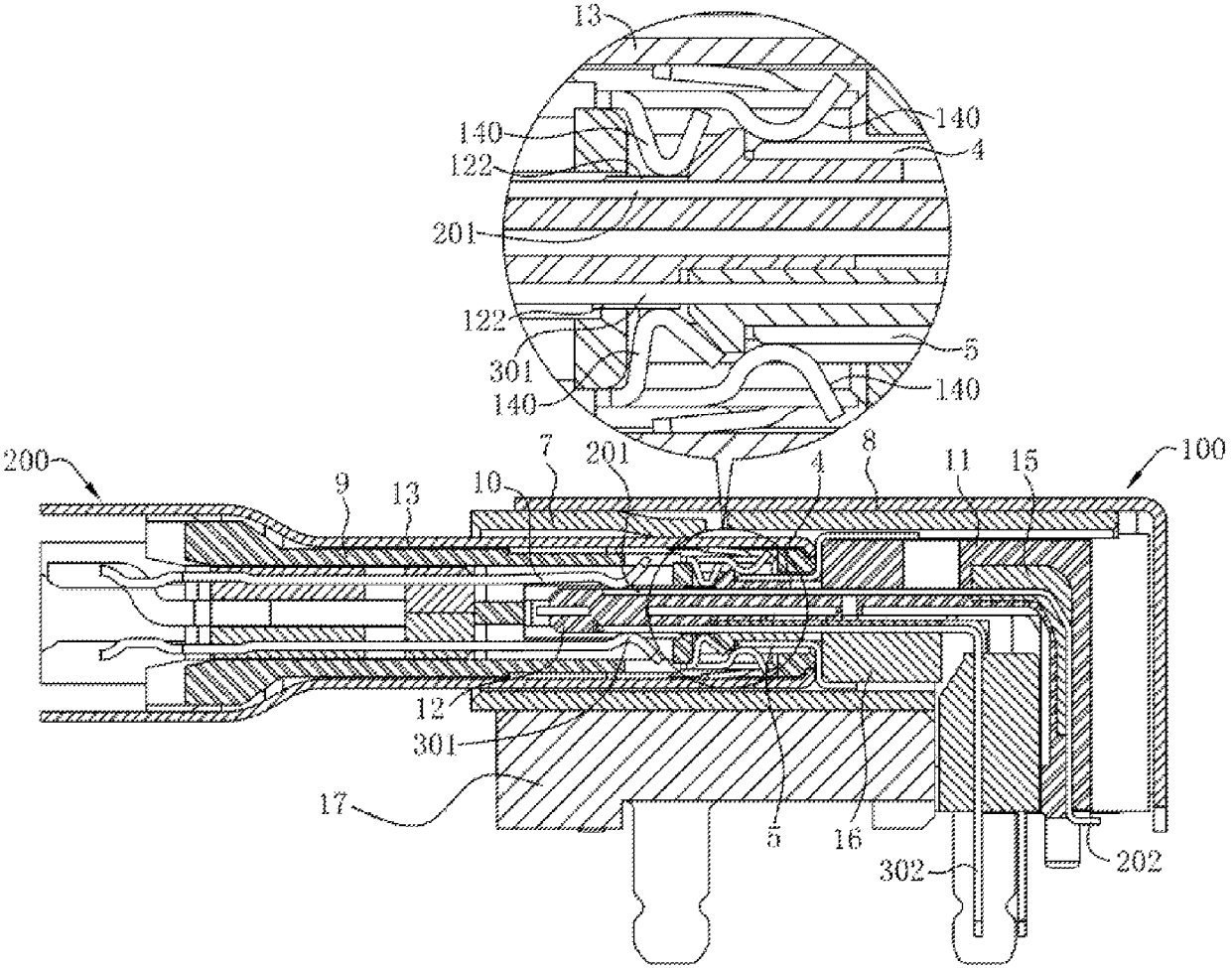
FIG. 6 is a sectional view obtained after the electrical connector mates the mating connector according to one embodiment of the present invention.
Figure 7:
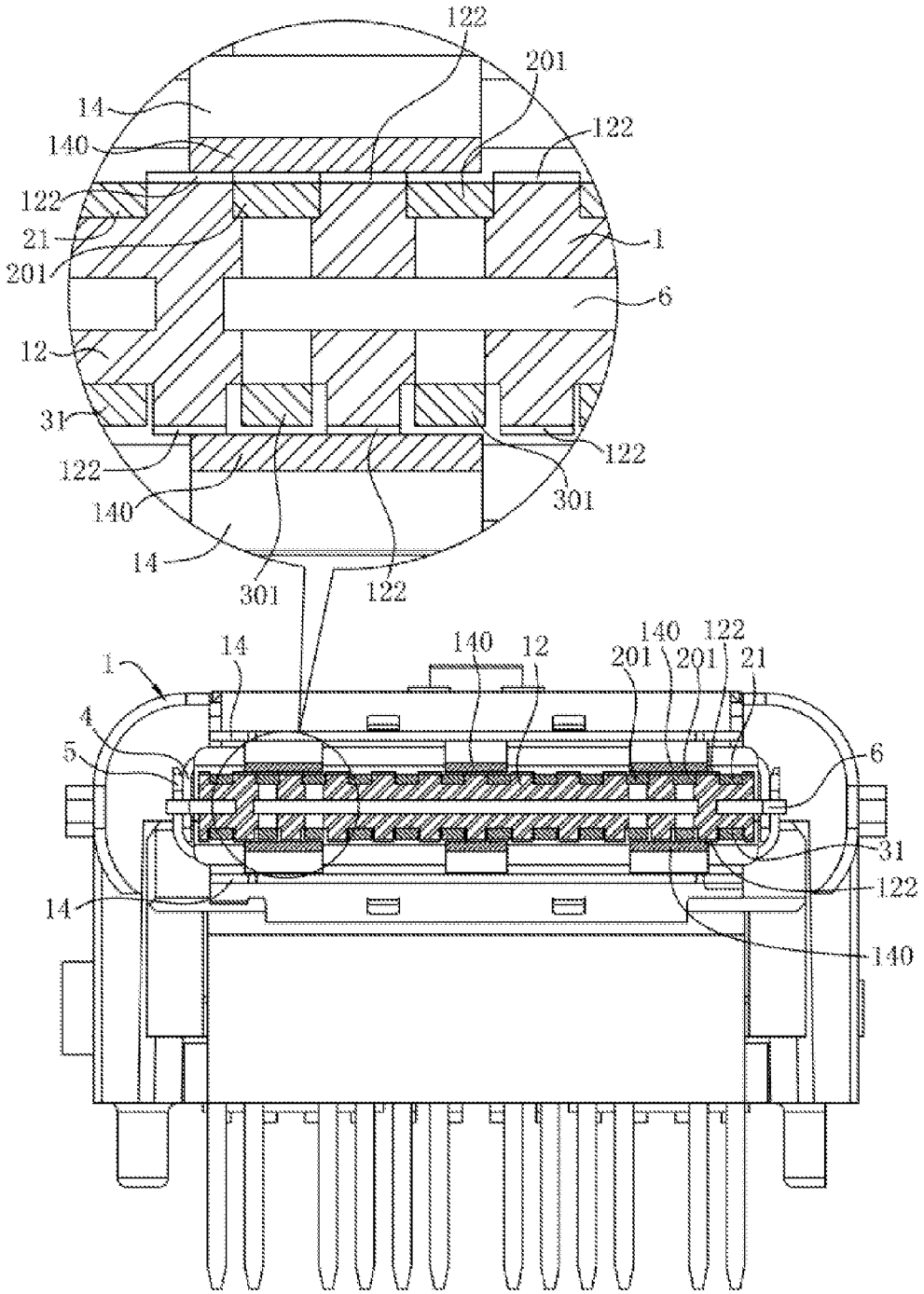
FIG. 7 is another sectional view obtained after the electrical connector mates the mating connector according to one embodiment of the present invention.

As shown in FIG. 2 and FIG. 5, an electrical connector 100 according to one embodiment of the present invention is installed on a circuit board (not shown), and is used for mating a mating connector 200. The electrical connector 100 includes an insulating body 1, multiple terminals divided into an upper row of terminals 2 and a lower row of terminals 3 disposed at the insulating body 1, a shielding sheet 6 disposed in the insulating body 1 and located between the upper row of terminals 2 and the lower row of terminals 3, a contact member (not labeled) disposed at the insulating body 1, a metal casing 7 framing the outer side of the insulating body 1 to form an insertion cavity 70, and a metal cover 8 soldered and fixed to the outside of the metal casing 7. Further, a booster block 17 may be fixed under the metal casing 7 for providing a support force to the electrical connector 100.

The mating connector 200 includes an insulating housing 9, two rows of conducting terminals 10, a masking casing 13, and two grounding members 14. A mating cavity 90 is depressed from a front end of the insulating housing 9. The two rows of conducting terminals 10 are disposed at the insulating housing 9 and located on an upper surface and a lower surface of the mating cavity 90. The masking casing 13 wraps the insulating housing 9. The two grounding members 14 are respectively disposed on an upper surface and a lower surface of the insulating housing 9 and located between the masking casing 13 and the insulating housing 9. The grounding members 14 are provided with multiple grounding elastic sheets 140 protruding and stretching into the mating cavity 90.

In certain embodiments, each of the upper row of terminals 2 and the lower row of terminals 3 includes twelve terminals, and the upper row of terminals 2 and the lower row of terminals 3 are arranged in reverse sequences in a parallel direction and arranged in symmetrical manners in a vertical direction, and transmit same signals. The upper row of terminals 2 are arranged in sequence from left to right and are sequentially a grounding terminal (GND) 21, a high-speed differential signal transmitting terminal pair (TX1+, TX1−) 20, a power supply terminal (Vbus), a reserved terminal (CC1), a USB2.0 differential terminal pair (Dp1, Dn1), a reserved terminal (SBU1), a power supply terminal (Vbus), a high-speed differential signal receiving terminal pair (RX2+, RX2−) 20, and a grounding terminal (GND) 21; and the lower row of terminals 3 are arranged in sequence from right to left and are sequentially a grounding terminal (GND) 31, a high-speed differential signal transmitting terminal pair (TX2+, TX2−) 30, a power supply terminal (Vbus), a reserved terminal (CC2), a USB2.0 differential terminal pair (Dp2, Dn2), a reserved terminal (SBU2), a power supply terminal (Vbus), a high-speed differential signal receiving terminal pair (RX1+, RX1−) 30, and a grounding terminal (GND) 31, so that the electrical connector 100 may be inserted in dual orientations.

As shown in FIGS. 2-7, the insulating body 1 includes a base 11 and a tongue 12 projecting forward from the base 11. The tongue 12 has a front segment 120 and a rear segment 121, and the height of the rear segment 121 is greater than the height of the front segment 120. Each of the upper row of terminals 2 and each of the lower row of terminals 3 include a mating portion 201 and a mating portion 301 that extend forward to the front segment 120 and are exposed from the front segment 120, and a soldering portion 202 and a soldering portion 302 that extend backward out of the base 11, respectively. Each of an upper surface and a lower surface of the front segment 120 close to the rear segment 121 is provided with multiple isolation portions 122. The multiple isolation portions 122 are separately disposed at two sides of each of the mating portions 201 and 301, and each of the isolation portions 122 is higher than the mating portions 201 and 301 and lower than the rear segment 121. The width of the grounding elastic sheet 140 is greater than the width of the mating portions 201 and 301, and multiple grounding elastic sheets 140 and multiple mating portions 201 and 301 are staggered. Moreover, the isolation portion 122 is at least partially located on an insertion path of the grounding elastic sheet 140. After the mating connector 200 and the electrical connector 100 are frequently mated, the grounding elastic sheet 140 collides with the tongue 12 multiple times to generate a pin collapse phenomenon, so that the grounding elastic sheet 140 is moved backward in the mating cavity 90. In this case, the isolation portion 122 isolates the grounding elastic sheet 140 from the mating portions 201 and 301 of the signal terminals 20 and 30, which prevents that the grounding elastic sheet 140 directly contacts the mating portions 201 and 301 of the signal terminals 20 and 30 to cause short circuit of the electrical connector 100.

The contact member is disposed at the rear segment 121, and includes an upper contact member 4 and a lower contact member 5. The upper contact member 4 is disposed on the upper surface of the rear segment 121, and the lower contact member 5 is disposed on the lower surface of the rear segment 121. The upper contact member 4 and the lower contact member 5 are snap-fit to each other and fixed to the rear segment 121. The upper contact member 4 and the lower contact member 5 include contact portions 40 and 50 that are located at the rear segment 121 and extending portions 41 and 51 that extend from the contact portions 40 and 50 to the base 11, respectively. When the electrical connector 100 and the mating connector 200 are mated, the two contact portions 40 and 50 are used for respectively buckling the grounding elastic sheets 140 of the two grounding members 14 and grounded. Besides, a stopping portion 123 higher than the contact member is disposed at a front end of the rear segment 121, so as to prevent the contact member from moving forward. The stopping portion 123 is provided with a guiding surface 124 that is located between the isolation portion 122 and the stopping portion 123, is higher than the isolation portion 122, and is used for guiding the grounding member 14 to be inserted and buckled with the contact member. In other embodiments, the contact member may also be one-piece, but is not limited thereto.

Moreover, the contact portions 40 and 50 and the extending portion 41 are respectively provided with elastic sheets 401, 501, and 411 that urge the grounding terminals 21 and 31, so as to implement mechanical and electrical contact between the contact member and the grounding terminals 21 and 31, and enhance the grounding effect of the electrical connector 100. Each of two sides of the extending portion 41 is provided with a locking sheet 413, the base 11 is provided with a locking slot 110 corresponding to each of the locking sheets 413. The locking sheets 413 are respectively inserted in the locking slots 110, to fix the extending portion 41 to the base 11, so as to increase stability of cooperation between the contact member and the insulating body 1. Besides, multiple elastic arms 412 urging the metal casing 7 extend backward from the extending portion 41 to implement mechanical and electrical contact between the contact member and the metal casing 7, so as to further enhance the grounding effect of the electrical connector 100.

The shielding sheet 6 includes a side edge 61 protruding from a left side surface and a right side surface of the tongue 12, and then a buckling slot 60 is depressed from the side edge 61, and provided for a buckling terminal (not shown) of the mating connector 200 to be buckled. The buckling slot 60 includes a first protruding portion 601 located at a front end of the buckling slot 60 and a second protruding portion 602 located at a back end of the buckling slot 60. When the buckling terminal of the mating connector 200 is buckled with the buckling slot 60, the first protruding portion 601 prevents the buckling terminal from being disengaged along a direction from front to rear, and the second protruding portion 602 prevents the buckling terminal from being excessively inserted. The isolation portion 122 extends forward and exceeds the second protruding portion 602, so as to increase the isolation blocking area of the isolation portion 122, and further prevent that the grounding elastic sheet 140 directly contacts the mating portions 201 and 301 of the signal terminals 20 and 30 to cause a short circuit. Additionally, the shielding sheet 6 further includes two grounding portions 603 extending out of two sides of the base 11, respectively, where the grounding portions 603 are soldered and fixed to the metal casing 7, so that the shielding sheet 6 contacts the metal casing 7, so as to enhance the electromagnetic interference (EMI) preventing effect of the electrical connector 100. In other embodiments, the buckling slot 60 may be also directly depressed from the tongue 12, which is not limited herein.

In this embodiment, steps of forming the electrical connector 100 are: the upper row of terminals 2 and an insulating block 15 are integrally injection molded first to position the upper row of terminals 2, and then the upper row of terminals 2, the insulating block 15 and the shielding sheet 6 are integrally injection molded into an upper terminal module (not shown). The lower row of terminals 3 and another insulating block 16 are integrally injection molded into a lower terminal module (not shown). Finally the lower terminal module is assembled to the upper terminal module, thereby forming an electrical connector body 101.

Figure 8:
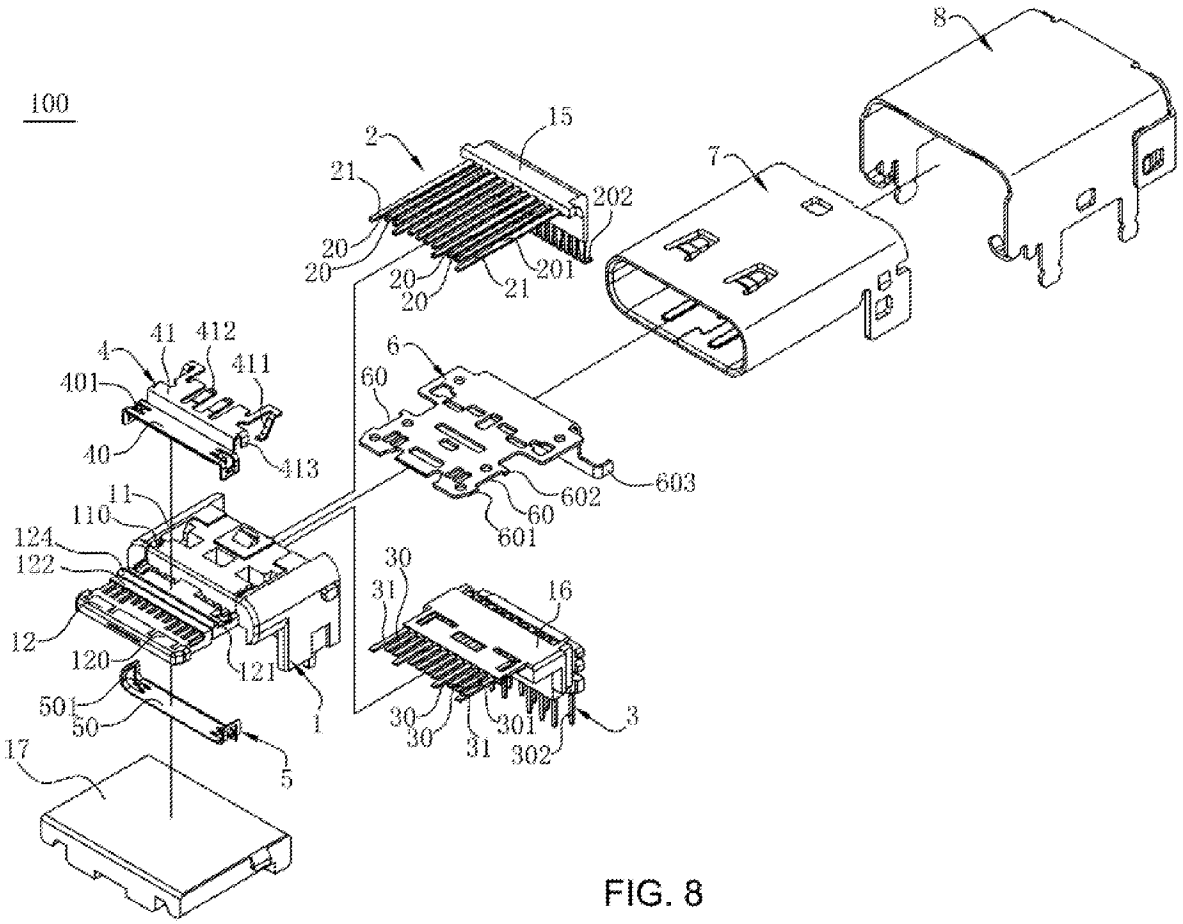
FIG. 8 is a three-dimensional exploded view of another embodiment of an electrical connector according to the present invention.
Figure 9:
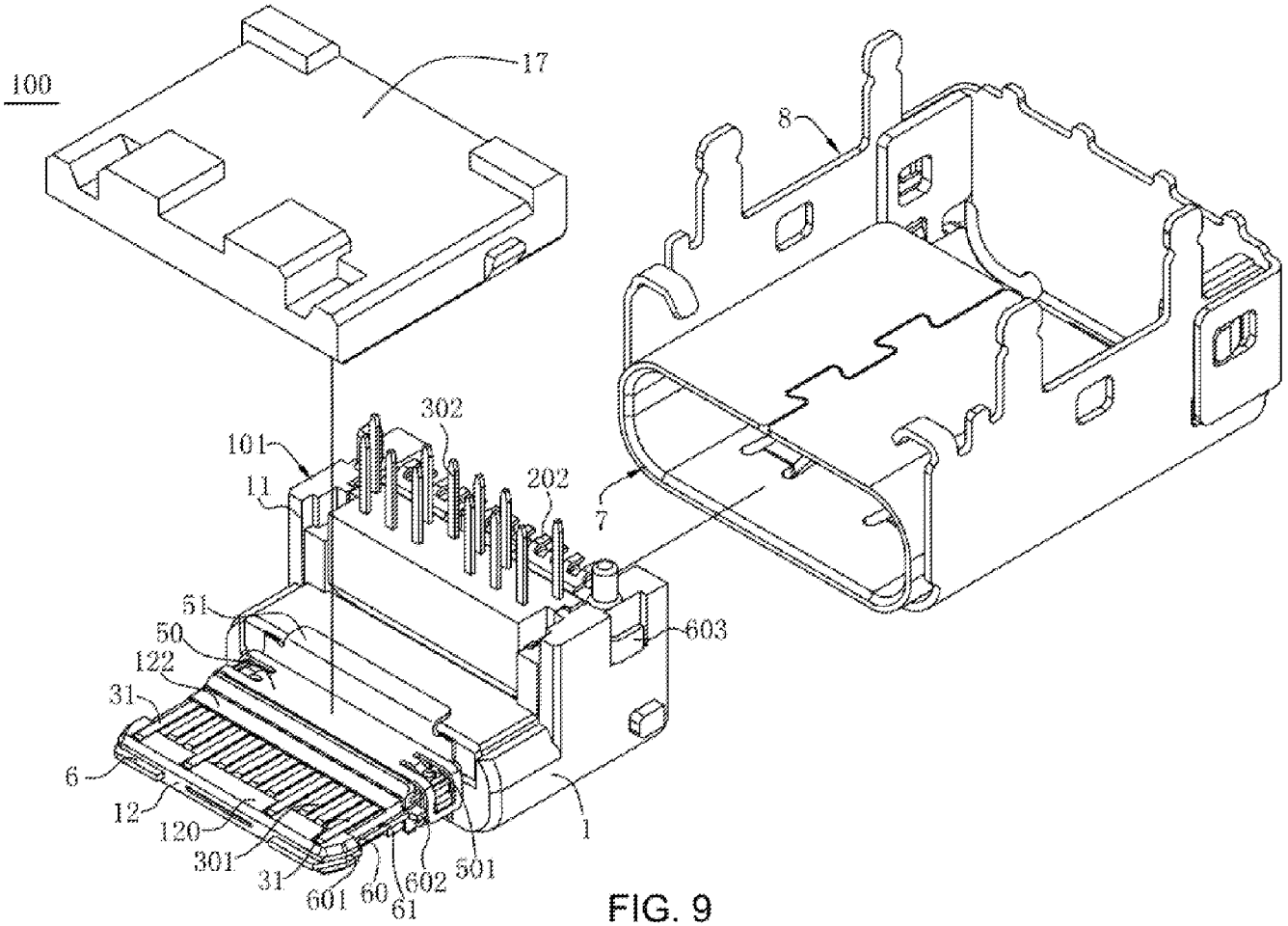
FIG. 9 is a partial three-dimensional exploded view of another embodiment of the electrical connector according to the present invention.
Figure 10:
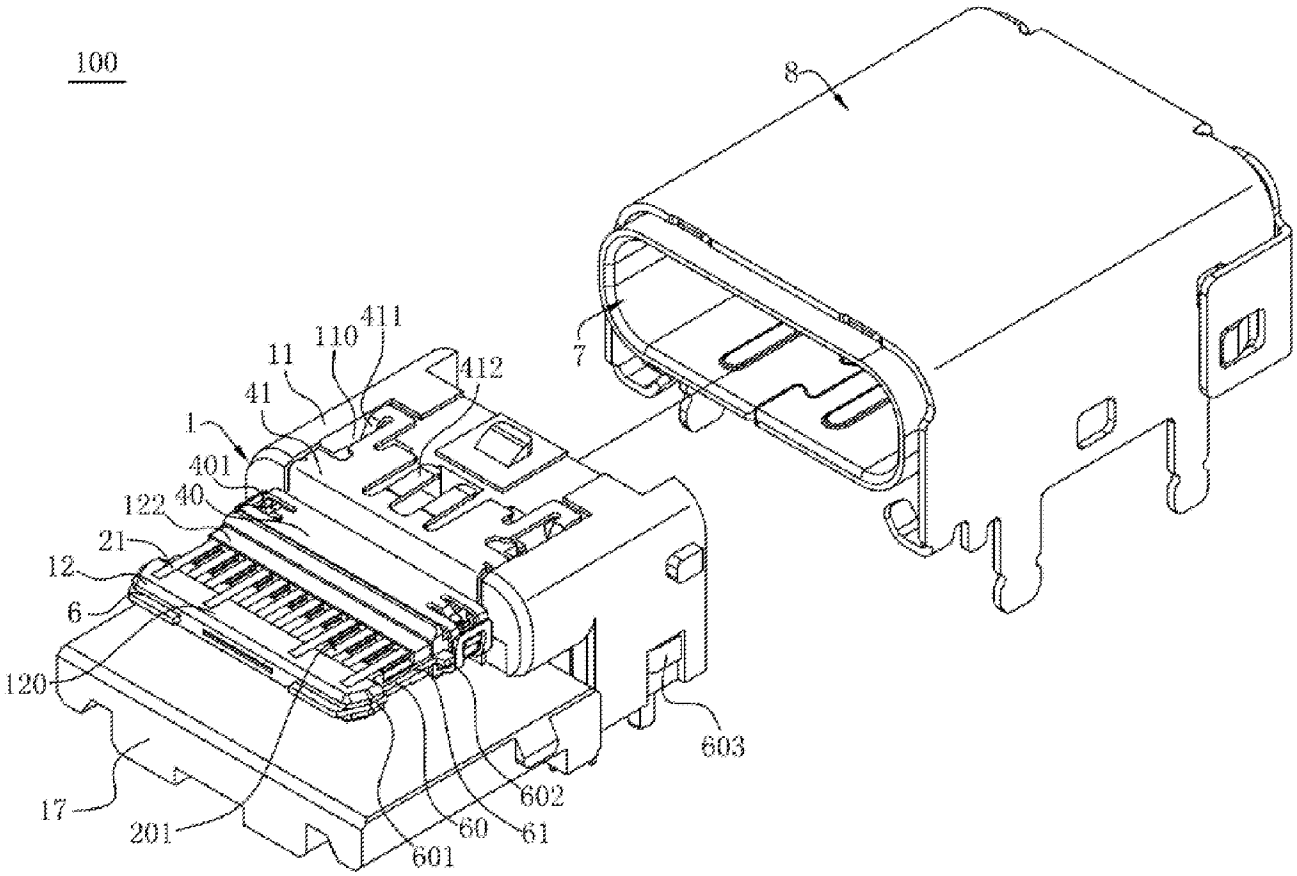
FIG. 10 is a partial three-dimensional exploded view at another angle of another embodiment of the electrical connector according to the present invention.

FIGS. 8-10 are schematic diagrams of another embodiment of an electrical connector according to the present invention. In this embodiment, other structures are the same as those in the foregoing embodiment, and are not repetitively described herein, and a difference lies in that multiple isolation portions 122 in this embodiment are connected integrally, so as to wrap a part of the mating portions 201 and 301 close to the rear segment 121, increase a blocking area of the isolation portion 122 blocked between the grounding elastic sheet 140 and the mating portions 201 and 301 of the signal terminals 20 and 30, further isolate the grounding elastic sheet 140 from the mating portions 201 and 301 of the signal terminals 20 and 30, and prevent that the grounding elastic sheet 140 directly contacts the mating portions 201 and 301 of the signal terminals 20 and 30 to cause short circuit of the electrical connector 100. In this embodiment, steps of forming the electrical connector 100 are: by the first injection molding, the upper row of terminals 2 and the shielding sheet 6 are injection molded into an upper terminal module; by the second injection molding, the lower row of terminals 3 and an insulating block 16 are injection molded into a lower terminal module; and finally by the third injection molding, the upper terminal module and the lower terminal module are injection molded into an electrical connector body 101.

In summary, the electrical connector 100 according to certain embodiment of the present invention, among other things, has the following beneficial advantages.

1. Each of the isolation portions 122 is higher than the mating portions 201 and 301 but lower than the rear segment 121, and the isolation portion 122 is at least partially located on the insertion path of the grounding elastic sheet 140. After the mating connector 200 and the electrical connector 100 are frequently mated, the grounding elastic sheet 140 collides with the tongue 12 multiple times to generate a pin collapse phenomenon, so that the grounding elastic sheet 140 is moved backward in the mating cavity 90. In this case, the isolation portion 122 isolates the grounding elastic sheet 140 from the mating portions 201 and 301 of the signal terminals 20 and 30, which prevents that the grounding elastic sheet 140 directly contacts the mating portions 201 and 301 of the signal terminals 20 and 30 to cause short circuit of the electrical connector 100.

2. Multiple isolation portions 122 are connected integrally, so as to wrap a part of the mating portions 201 and 301 close to the rear segment 121, increase a blocking area of the isolation portion 122 blocked between the grounding elastic sheet 140 and the mating portions 201 and 301 of the signal terminals 20 and 30, further isolate the grounding elastic sheet 140 from the mating portions 201 and 301 of the signal terminals 20 and 30, and prevent that the grounding elastic sheet 140 directly contacts the mating portions 201 and 301 of the signal terminals 20 and 30 to cause short circuit of the electrical connector 100.

3. The isolation portion 122 extends forward and exceeds the second protruding portion 602, so as to increase the isolation blocking area of the isolation portion 122, and further prevent that the grounding elastic sheet 140 directly contacts the contact portions 40 and 50 to cause short circuit of the electrical connector 100.

4. A stopping portion 123 higher than the contact member is disposed at a front end of the rear segment 121, so as to prevent the contact member from moving forward; and the stopping portion 123 is provided with a guiding surface 124 that is located between the isolation portion 122 and the stopping portion 123, is higher than the isolation portion 122, and is used for guiding the grounding member 14 to be inserted and buckled with the contact member.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an insulating body comprising a base and a tongue extending forward from the base, wherein the tongue has a rear segment and a front segment, and the rear segment is higher than the front segment;

a plurality of terminals received in the insulating body, wherein each of the terminals comprises a mating portion exposed on the front segment, the front segment is provided with at least one isolation portion close to the rear segment, and the isolation portion is higher than the mating portion and lower than the rear segment; and a contact member, disposed at the rear segment, and used for buckling a grounding elastic sheet of a mating connector during mating, wherein the isolation portion is at least partially located on an insertion path of the grounding elastic sheet.

2. The electrical connector of claim 1, wherein a number of the at least one isolation portion is two or more, and the two or more isolation portions are respectively disposed at two sides of each of the mating portions of the terminals.

3. The electrical connector of claim 2, wherein each of an upper surface and a lower surface of the front segment are disposed with multiple of the isolation portions at a location close to the rear segment.

4. The electrical connector of claim 1, wherein a number of the at least one isolation portion is two or more, and the two or more isolation portions are integrally formed and wrap a part of each of the mating portions at a location close to the rear segment.

5. The electrical connector of claim 1, further comprising a shielding sheet at least partially located in the tongue, wherein the shielding sheet comprises a buckling slot protruding from a side surface of the tongue, and the buckling slot has a first protruding portion located at a front end of the buckling slot and a second protruding portion located at a back end of the buckling slot.

6. The electrical connector of claim 5, wherein the isolation portion extends forward and exceeds the second protruding portion.

7. The electrical connector of claim 1, further comprising a metal casing framing the insulating body, and the metal casing surrounding the tongue to form an insertion cavity.

8. The electrical connector of claim 7, wherein the contact member comprises a contact portion disposed at the rear segment and an extending portion extending from the contact portion to the base, and the extending portion is provided with an elastic arm urging the metal casing.

9. The electrical connector of claim 8, wherein each of two sides of the extending portion is provided with a locking sheet, the base is provided with a locking slot corresponding to each locking sheet, and the locking sheets are respectively inserted in the locking slots.

10. The electrical connector of claim 1, wherein a stopping portion higher than the contact member is disposed at a front end of the rear segment, and the stopping portion comprises a guiding surface that is located between the isolation portion and the stopping portion and is higher than the isolation portion.

11. The electrical connector of claim 1, wherein a width of the grounding elastic sheet is greater than a width of the mating portion.

12. The electrical connector of claim 1, wherein the grounding elastic sheet and the mating portion are staggered.

13. An electrical connector, comprising:

an insulating body comprising a base and a tongue extending forward from the base;

two buckling slots, respectively located at a left side and a right side of the tongue, wherein a back end of each of the buckling slots is provided with a protruding portion;

a plurality of terminals received in the insulating body, wherein each of the terminals comprises a mating portion exposed on the tongue;

at least one isolation portion, protruding from the tongue and being higher than the mating portion, and extending forward and exceeding the protruding portion; and a shielding sheet at least partially located in the tongue, wherein the shielding sheet comprises a side edge protruding from each of a left side surface and a right side surface of the tongue, and the buckling slots are depressed from the side edge.

14. The electrical connector of claim 13, wherein a number of the at least one isolation portion is two or more, and the two or more isolation portions are respectively disposed at two sides of each of the mating portions of the terminals.

15. The electrical connector of claim 14, wherein each of an upper surface and a lower surface of the tongue is disposed with multiple of the isolation portions.

16. The electrical connector of claim 13, wherein a number of the at least one isolation portion is two or more, and the two or more isolation portions are integrally formed and wrap a back end part of each of the mating portions.

17. The electrical connector of claim 13, wherein each of the buckling slots is depressed from the tongue.

18. The electrical connector of claim 13, wherein the tongue comprises a rear segment and a front segment, the rear segment is higher than the front segment, the isolation portion is disposed at the front segment and close to the rear segment, and the isolation portion is lower than the rear segment.

19. The electrical connector of claim 18, wherein a stopping portion higher than the contact member is disposed at a front end of the rear segment, and the stopping portion comprises a guiding surface that is located between the isolation portion and the stopping portion and is higher than the isolation portion.

* * * * *